US007172477B1

(12) United States Patent
Rollins

(10) Patent No.: US 7,172,477 B1
(45) Date of Patent: Feb. 6, 2007

(54) SAFETY PROPELLER

(76) Inventor: Houston Rollins, 12846 Marsh Rd., Spring Hill, FL (US) 34610

( * ) Notice: Subject to any disclaimer, the term of this patent is extended or adjusted under 35 U.S.C. 154(b) by 0 days.

(21) Appl. No.: 11/417,704

(22) Filed: May 4, 2006

Related U.S. Application Data

(60) Provisional application No. 60/704,969, filed on Aug. 3, 2005, provisional application No. 60/677,461, filed on May 4, 2005.

(51) Int. Cl.
*B63H 5/16* (2006.01)

(52) U.S. Cl. ..... 440/71; 416/247 A

(58) Field of Classification Search ..... 440/38, 440/71, 72; 416/247 R, 247 A
See application file for complete search history.

(56) References Cited

U.S. PATENT DOCUMENTS 3,261,544 A * 7/1966 Guichard ..... 416/171
3,574,477 A * 4/1971 Dolf et al. ..... 415/60
4,070,984 A * 1/1978 Kappas ..... 440/72
4,182,118 A * 1/1980 Chronic ..... 60/221
4,427,393 A * 1/1984 May ..... 440/67
4,680,017 A * 7/1987 Eller ..... 440/66
4,767,269 A * 8/1988 Brandt ..... 416/124
6,244,818 B1 * 6/2001 Chang ..... 415/208.2
2003/0114052 A1 * 6/2003 Schultz et al. ..... 440/17

* cited by examiner

*Primary Examiner*—Stephen Avila
(74) *Attorney, Agent, or Firm*—Kenneth L Tolar

(57) ABSTRACT

A safety propeller for a boat motor includes an annular collar having a front opening, a rear opening and a continuous peripheral wall. A plurality of angled, horizontal slits are circumferentially positioned about the peripheral wall to allow water to pass through the collar. Both the front opening and rear opening each include a plurality of guard blades radially extending from a centrally disposed hub. Between the front and rear guard blades is a main propeller likewise including a plurality of blades radially extending from a centrally disposed hub. The collar, guard blades, main propeller, shaft and hubs are integrally connected to form a unitary structure. Accordingly, when the device is operably connected to a boat motor drive means, the guard blades and main propeller rotate in unison to propel a boat through water. The guard blades are positioned at a discrete angle and pitch so as to project animals, humans and objects away from the device.

5 Claims, 1 Drawing Sheet

SAFETY PROPELLER

CROSS REFERENCE TO RELATED APPLICATIONS

This application is entitled to the benefit of provisional application Nos. 60/704,969 filed on Aug. 3, 3005 and 60/677,461 filed on May 4, 2005, the specifications of which are incorporated herein by reference.

BACKGROUND OF THE INVENTION

The present invention relates to a new, unitary boat motor propeller having integral protective blades for minimizing injuries to nearby humans, animals and underwater ecosystems.

DESCRIPTION OF THE PRIOR ART

Many injuries and deaths occur each year when people inadvertently contact an operating boat motor propeller. Furthermore, many endangered species, such as the manatee, are needlessly injured or killed when they are cut by the propellers of various boats. Accordingly, there is currently a need for a device that increases the safety associated with motorized boat propellers. The present invention addresses this need by providing a unitary propeller that includes a main propeller with guard blades positioned on each of two sides thereof; the distal ends of the guard blades and the main propeller blades are integrally attached to a circumferential collar all of which prevent nearby objects, animals or humans from contacting the injurious main propeller.

SUMMARY OF THE INVENTION

The present invention relates to a unitary safety propeller for a boat motor including an annular collar having a front opening, a rear opening and a continuous peripheral wall. A plurality of horizontal, angled slits are circumferentially positioned about the peripheral wall to allow water to pass through the collar. Both the front opening and the rear opening each include a plurality of guard blades radially extending from a centrally disposed hub. Positioned between the front and rear guard blades is a main propeller likewise including a plurality of blades radially extending from a hub. Each of the blade hubs are integrally affixed to a central drive shaft that is operably connected to a boat motor. The distal ends of each of the guard blades and main propeller blades are integrally connected to the interior surface of the collar so that all of the aforementioned components form a unitary propeller structure. Accordingly, when the shaft is operably connected to a boat motor drive means, the entire unit including the guard blades, the main propeller blades, the collar and shaft all rotate in unison; as the unit rotates, the guard blades prevent animals, humans and objects from contacting the main propeller.

It is therefore an object of the present invention to provide a device that enhances the safety associated with boat motors.

It is another object of the present invention to provide a boat motor propeller having protective guard blades that prevent nearby objects from engaging the propeller.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
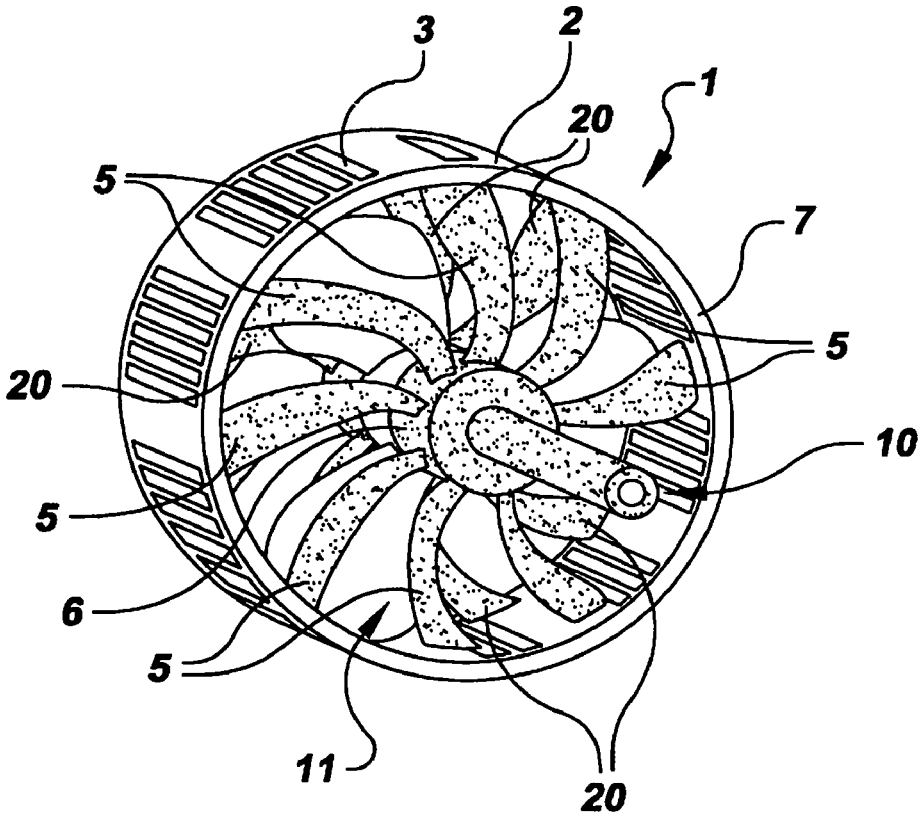
FIG. 1 is a perspective view of the device.

The present invention relates to a safety propeller for a boat motor. The device comprises an annular collar 1 having a continuous peripheral wall 2, a continuous front edge that defines a front opening and a continuous rear edge that defines a rear opening. A plurality of angled, horizontal slits 3 are circumferentially positioned about the peripheral wall that allow water to flow through the collar. The front opening includes a plurality of front guard blades 5 radially extending from a centrally disposed hub 6. Likewise, the rear opening includes a plurality rear guard blades 20 radially extending from a central hub. The front edge and the rear edge of the collar each include a tapered lip 7 that decreases drag as the device moves through water. The tapered lips are similar in design to an actual dorsal fin of a dolphin.

Positioned between the front and rear guard blades is a main propeller 11 including a plurality of blades radially extending from a hub. Each of the blade hubs are integrally affixed to a central drive shaft 10 that is operably connected to a boat motor. The distal ends of each of the guard blades and main propeller blades are integrally connected to the interior surface of the collar so that all of the aforementioned components form a unitary propeller structure.

The safety propeller is secured to a boat motor in a similar manner as a conventional propeller. When the boat motor is operating, all of the above described components including the shaft, guard blades and main propeller blade rotate in unison to efficiently propel the boat through water. However, the angle and pitch of the guard blades are such that an engaging object or animal will be immediately propelled away from the device thereby preventing contact with the rotating main propeller blades.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A safety propeller for a boat motor comprising:

an annular collar having a continuous peripheral wall with an interior surface, a continuous front edge that defines a front opening and a continuous rear edge that defines a rear opening;

a plurality of front guard blades positioned within the front opening;

a plurality of rear guard blades positioned within the rear opening;

a main propeller formed of a plurality of main propeller blades positioned between the front guard blades and rear guard blades;

a central drive shaft connected to said main propeller, said front guard blades and said rear guard blades whereby said drive shaft is connected to a boat motor drive means so that a boat motor rotates said front guard blades, said rear guard blades and said main propeller in unison.

2. The safety propeller according to claim 1 wherein each of said front guard blades, said rear guard blades and said main propeller blades include a distal end, each distal end integrally connected to the interior surface of the collar so that said front guard blades, said rear guard blades, said main propeller blades, said collar and said drive shaft form a unitary structure.

3. The propeller according to claim 1 further comprising a plurality of angled, horizontal slits circumferentially positioned about the peripheral wall of said collar that allow water to flow therethrough.

4. The propeller according to claim 1 wherein the front edge and the rear edge of the collar each include a tapered lip that decreases drag as the safety propeller moves through water.

5. The propeller according to claim 1 wherein the front guard blades and the rear guard blades each have a discrete angle and pitch such that an engaging object will be immediately propelled away from the safety propeller thereby preventing contact with the main propeller blades.

* * * * *